US005734791A

United States Patent [19]

Acero et al.

[11] Patent Number: 5,734,791

[45] Date of Patent: Mar. 31, 1998

[54] RAPID TREE-BASED METHOD FOR VECTOR QUANTIZATION

[75] Inventors: Alejandro Acero, Madrid, Spain; Kai-Fu Lee; Yen-Lu Chow, both of Saratoga, Calif.

[73] Assignee: Apple Computer, Inc., Cupertino, Calif.

[21] Appl. No.: 999,354

[22] Filed: Dec. 31, 1992

[51] Int. Cl.[6] ..... G10L 3/02

[52] U.S. Cl. ..... 395/2.31; 395/2.09

[58] Field of Search ..... 395/2, 2.31, 2.39, 395/2.29, 2.09; 348/417, 469, 418; 375/25, 27, 240, 245

[56] References Cited

U.S. PATENT DOCUMENTS

| | | | |
|---|---|---|---|
| Re. 34,562 | 3/1994 | Murakami et al. | 348/417 |
| 4,348,553 | 9/1982 | Baker et al. | 395/2.5 |
| 4,727,354 | 2/1988 | Lindsay | 341/106 |
| 4,878,230 | 10/1989 | Murakami et al. | 348/417 |
| 4,903,305 | 2/1990 | Gillick et al. | 395/2.54 |
| 5,021,971 | 6/1991 | Lindsay | 395/2.29 |
| 5,027,406 | 6/1991 | Roberts et al. | 395/2 |
| 5,194,950 | 3/1993 | Murakami et al. | 348/417 |
| 5,291,286 | 3/1994 | Murakami et al. | 348/469 |
| 5,297,170 | 3/1994 | Eyuboglu et al. | 375/25 |

FOREIGN PATENT DOCUMENTS

| | | | |
|---|---|---|---|
| 0138061 | 4/1985 | European Pat. Off. | G10L 7/08 |
| 0313975 | 10/1988 | European Pat. Off. | G10L 5/06 |
| 881173736 | 10/1988 | European Pat. Off. | G06F 15/36 |
| 0389271 | 3/1990 | European Pat. Off. | G06F 15/40 |

OTHER PUBLICATIONS

George M. White, "Speech Recognition, Neural Nets, and Brains", Jan. 1992, pp. 1–48.

Kai-Fu Lee, "Large-Vocabulary Speaker-Independent Continuous Speech Recogniton: The Sphinx System" Carnegie Mellon University, Pittsburgh, Pennsylvania, Apr. 1988, pp. 1–184.

Ronald W. Schafer and Lawrence R. Rabiner, "Digital Representations of Speech Signals" The Institute of Electrical and Electronics Engineers, Inc., 1975, pp. 49–63.

D. Raj Reddy, "Speech Recognition by Machine: A Review-"IEEE Proceedings 64(4):502–531, Apr. 1976, pp. 8–35.

Robert M. Gray, "Vector Quantization" IEEE,1984, pp. 75–100.

Rabiner, L., Sondhi, M. and Levison, S., "Note on the Properties of a Vector Quantizer for LPC Coefficients," vol. 62, No. 8, Oct. 1983, pp. 2603–2615, Bell System Technical Journal.

Linde, Y., Buzo, A., and Gray, R.M., "An Algorithm for Vector Quantization," IEEE Trans. Commun., COM-28, No. 1 (Jan. 1980) pp. 84–95.

(List continued on next page.)

*Primary Examiner*—Allen R. MacDonald
*Assistant Examiner*—Richemond Dorvil
*Attorney, Agent, or Firm*—Blakely, Sokoloff, Taylor & Zafman

[57] ABSTRACT

The branching decision for each node in a vector quantization (VQ) binary tree is made by a simple comparison of a pre-selected element of the candidate vector with a stored threshold resulting in a binary decision for reaching the next lower level. Each node has a preassigned element and threshold value. Conventional centroid distance training techniques (such as LBG and k-means) are used to establish code-book indices corresponding to a set of VQ centroids. The set of training vectors are used a second time to select a vector element and threshold value at each node that approximately splits the data evenly. After processing the training vectors through the binary tree using threshold decisions, a histogram is generated for each code-book index that represents the number of times a training vector belonging to a given index set appeared at each index. The final quantization is accomplished by processing and then selecting the nearest centroid belonging to that histogram. Accuracy comparable to that achieved by conventional binary tree VQ is realized but with almost a full magnitude increase in processing speed.

22 Claims, 11 Drawing Sheets

OTHER PUBLICATIONS

Bahl, I.R., et al., "Large Vocabulary National Language Continuous Speech Recognition," Proceeding of the IEEE ICASSP 1989, Glasgow, pp. 465–467.

Gray, R.M., "Vector Quantization", IEEE ASSP Magazine, Apr. 1984, vol. 1, No. 2, pp. 4–29.

Bahl, L.R., Baker, J.L., Cohen, P.S., Jelineck, F., Lewis, B.L., Mercer, R.L., "Recognition of a Continuously Read Natural Corpus" IEEE Int. Conf. on Acoustics, Speech and Signal Processing, Apr. 1978, pp. 422–424.

Schwartz, R., Chow, Y., Kimball, Ol, Roucos, S., Krasner, M., Makhoul, J., "Context–Dependent Modeling for Acoustic–Phonetic Recognition of Continuous Speech," IEEE Int. Conf. on Acoustics, Speech and Signal Processing, Apr. 1985, pp. 1205–1208.

Schwartz, R.M., Chow, S.L., Roucos, S., Krauser, M., Makhoul, J., "Improved Hidden Markov Modeling of Phonemes for Continuous Speech Recognition," IEEE Int. Conf. on Acoustics, Speech and Signal Processing, Apr. 1984, pp. 35.6.1–35.6.4.

Alleva, F. Hon, H., Huang, X., Hwang, M., Rosenfeld, R., Weide, R., "Applying Sphinx II to DARPA Wall Street Journal CSR Task", Proc. of the DARPA Speech and NL Workshop, Feb. 1992, Morgan Kaufman Pub., San Mateo, CA, pp. 393–398.

Kai–Fu Lee, "Automatic Speech Recognition," Kluwer Academic Publishers, Boston/Dordrecht/London, 1989, pp. 1–203.

Tenenbaum et al., *Data Structures Using Pascal*, 1981, Prentice–Hall, Inc., pp. 252–283.

Buzo et al., "Speech Coding Based Upon Vector Quantization," IEEE Trans on ASSP, vol. ASSP–28, No. 5, Oct. 1980, pp. 562–574.

Parsons, "Voice and Speech Processing," 1987 by McGraw–Hill, Inc., pp. 203–213.

RAPID TREE-BASED METHOD FOR VECTOR QUANTIZATION

FIELD OF THE INVENTION

The present invention relates to a method for vector quantization (VQ) of input data vectors. More specifically, this invention relates to the vector quantization of voice data in the form of linear predictive coding (LPC) vectors including stationary and differenced LPC cepstral coefficients, as well as power and differenced power coefficients.

BACKGROUND OF THE INVENTION

Speech encoding systems have gone through a lengthy development process in voice coding (vocoder) systems used for bandwidth efficient transmission of voice signals. Typically, the vocoders were based on an abstracted model of the human voice generating of a driving signal and a set of filters modeling the resources of the vocal track. The driving signal could either be periodical representing the pitch of the speaker or random representative of noise like fricatives for example. The pitch signal is primarily representative of the speaker (e.g. male vs. female) while the filter characteristics are more indicative of the type of utterance or information contained in the voice signal. For example, vocoders may extract time varying pitch and filter description parameters which are transmitted and used for the reconstruction of the voice data. If the filter parameters are used as received, but the pitch is changed, the reconstructed speech signal is interpretable but speaker recognition is destroyed because, for example, a male speaker may sound like a female speaker if the frequency of the pitch signal is increased. Thus, for vocoder systems, both excitation signal parameters and filter model parameters are important because speaker recognition is usually mandatory.

A method of speech encoding known as linear predictive coding (LPC) has emerged as a dominant approach to filter parameter extraction of vocoder systems. A number of different filter parameter extraction schemes lumped under this LPC label have been used to describe the filter characteristics yielding roughly equivalent time or frequency domain parameters. For example, refer to Markel, J. D. and Gray, Jr., A. H., "Linear Production of Speech," Springer, Berlin Herdelberg N.Y., 1976.

These LPC parameters represent a time varying model of the formants or resonances of the vocal tract (without pitch) and are used not only in vocoder systems but also in speech recognition systems because they are more speaker independent than the combined or raw voice signal containing pitch and formant data.

FIG. 1 is a functional block diagram of the "front-end" of a voice processing system suitable for use in the encoding (sending) end of a vocoder system or as a data acquisition subsystem for a speech recognition system. (In the case of a vocoder system, a pitch extraction subsystem is also required.)

The acoustic voice signal is transformed into an electrical signal by microphone 11 and fed into an analog-to-digital converter (ADC) 13 for quantizing data typically at a sampling rate of 16 kHz (ADC 13 may also include an anti-aliasing filter). The quantized sampled data is applied to a single zero pre-emphasis filter 15 for "whitening" the spectrum. The pre-emphasized signal is applied to unit 17 that produces segmented blocks of data, each block overlapping the adjacent blocks by 50%. Windowing unit 19 applies a window, commonly of the Hamming type, to each block supplied by unit 17 for the purpose of controlling spectral leakage. The output is processed by LPC unit 21 that extracts the LPC coefficients $\{a_k\}$ that are descriptive of the vocal tract formant all pole filter represented by the z-transform transfer function $$\frac{\sqrt{\alpha}}{A(z)},$$

where $$A(z)=1+a_1z^{-1}+a_2z^{-2}\ldots+a_mz^{-m}$$

$\sqrt{\alpha}$ is a gain factor and, $8\leqq m\leqq 12$ (typically).

Cepstral processor 23 performs a transformation on the LPC coefficient parameter $\{a_k\}$ to produce a set of informationally equivalent cepstral coefficients by use of the following iterative relationship $$c(n)=-\left[a_n+\frac{1}{n}\sum_{k=1}^{n-1}(n-k)\cdot c(n-k)\cdot a_k\right]$$

where $a_0=1$ and $a_k=0$ for $k>M$. The set of cepstral coefficients, $\{c(k)\}$, define the filter in terms of the logarithm of the filter transfer function, or $$\ln\left\{\frac{r\alpha}{A(z)}\right\}=\frac{1}{2}\ln\alpha+\sum_{k=1}^{P}c(k)z^{-k}$$

For further details, refer to Markel and Gray (op. cit.).

The output of cepstral processor 23 is a cepstral data vector, $C=[c_1\ c_2\ldots c_P]$, that is applied to VQ 20 for the vector quantization of the cepstral data vector C into a VQ vector, $\hat{C}$.

The purpose of VQ 20 is to reduce the degrees of freedom that may be present in the cepstral vector C. For example, the P-components, $\{c_k\}$, of C are typically floating point numbers so that each may assume a very large range of values (far in excess of the quantization range at the output of ADC 13). This reduction is accomplished by using a relatively sparse code-book represented by memory unit 27 that spans the vector space of the set of C vectors. VQ matching unit 25 compares an input cepstral vector $C_i$ with the set of vectors $\{\hat{C}_j\}$ stored in unit 27 and selects the specific VQ vector $\hat{C}_i=[\hat{C}_1\ \hat{C}_2\ldots\hat{C}_P]_i^T$ that is nearest to cepstral vector C. Nearness is measured by a distance metric. The usual distance metric is of the quadratic form $$d(C_i,\hat{C}_j)=(C_i-\hat{C}_j)^TW(C_i-\hat{C}_j)$$

where W is a positive definite weighting matrix, often taken to be the identity matrix, I. Once the closest vector, $\hat{C}_j$, of code-book 27 is found, the index, i, is sufficient to represent it. Thus, for example, if the cepstral vector C has 12 components, $[c_1\ c_2\ldots c_{12}]^T$, each represented by a 32-bit floating point number, the 384 bit C-vector is typically replaced by the index $i=1, 2, \ldots, 256$ requiring only 8 bits. This compression is achieved at the price of increased distortion (error) represented by the difference between vectors $\hat{C}$ and C, or the difference between the waveforms represented by $\hat{C}$ and C.

Obviously, generation of the entries in code-book 27 is critical to the performance of VQ 20. One commonly used method, commonly known as the LBG algorithm, has been described (Linde, Y., Buzo, A., end Gray, R. M., "An Algorithm for Vector Quantization," IEEE Trans. Commun., COM-28, No. 1 (Jan. 1980), pp. 84–95). It is an iterative procedure that requires an initial training sequence and an initial set of VQ code-book vectors.

FIG. 2 is a flow diagram of the basic LBG algorithm. The process begins in step 90 with an initial set of code-book vectors, $\{\hat{C}_j\}0$, and a set of training vectors, $\{C_{ti}\}$. The components of these vectors represent their coordinates in the multi-dimensional vector space. In the encode step 92, each training vector is compared with the initial set of code-book vectors and each training vector is assigned to the closest code-book vector. Step 94 measures an overall error based on the distance between the coordinates of each training vector and the code-book vector to which it has been assigned in step 92. Test step 96 checks to see if the overall error is within acceptable limits, and, if so, ends the process. If not, the process moves to step 98 where a new set of code-book vectors, $\{\hat{C}_j\}k$, is generated corresponding to the centroids of the coordinates of each subset of training vectors previously assigned in step 92 to a specific code-book vector. The process then advances to step 92 for another iteration.

FIG. 3 is a flow diagram of a variation on the LBG training algorithm in which the size of the initial code-book is progressively doubled until the desired code-book size is attained as described by Rabine, L., Sondhi, M., and Levinson S., "Note on the Properties of a Vector Quantizer for LPC Coefficients," BSTJ, Vol. 62, No. 8, Oct. 1983 pp. 2603–2615. The process begins at step 100 and proceeds to step 102, where two (M=2) candidate code vectors (centroids) are established. In step 104, each vector of the training set {T}, is assigned to the closest candidate code vector and then the average error (distortion, $\bar{d}(M)$) is computed using the candidate vectors and the assumed assignment of the training vectors into M clusters. Step 108 compares the normalized difference between the computed average distortion, $\bar{d}(M)$, with the previously computed average distortion, $d_{old}$. If the normalized absolute difference does not exceed a preset threshold, $\epsilon$, $d_{old}$ is set equal to $\bar{d}(M)$ and a new candidate centroid is computed in step 112 and a new iteration through steps 104, 106 and 108 is performed. If threshold is exceeded, indicating a significant increase in distortion or divergence over the prior iteration, the prior computed centroids in step 112 are stored and if the value of M is less than the maximum preset value M*, test step 114 advances the process to step 116 where M is doubled. Step 118 splits the existing centroids last computed in step 112 and then proceeds to step 104 for a new set of inner-loop iterations. If the required number of centroids (code-book vectors) is equal to M*, step 114 causes the process to terminate.

The present invention may be practiced with other VQ code-book generating (training) methods based on distance metrics. For example, Bahl, et al. describe a "supervised VQ" wherein the code-book vectors (centroids) are chosen to best correspond to phonetic labels (Bahl, I. R., et al., "Large Vocabulary National Language Continuous Speech Recognition", Proceeding of the IEEE CASSP 1989, Glasgow). Also, the k-means method or a variant thereof may be used in which an initial set of centroids is selected from widely spaced vectors of the training sequence (Grey, R. M., "Vector Quanitization", IEEE ASSP Magazine, April 1984, Vol. 1, No. 2, p. 10).

Once a "training" procedure such as outlined above has been used to generate a VQ code-book, it may be used for the encoding of data.

For example, in a speech recognition system, such as the SPHINX described in Lee, K., "Automatic Speech Recognition, The Development of the SPHINX System," Kluwer Academic Publishers, Boston/Dordrecht/London, 1989, the VQ code-book contains 256 vectors entries. Each cepstral vector has 12 component elements.

The vector code to be assigned by VQ 20 is properly determined by measuring the distance between each code-book vector, $\hat{C}_j$, and the candidate vector, $C_i$. The distance metric used is the unweighted (W=I) Euclidean quadratic form $$d(C_i, \hat{C}_j)=(C_i-\hat{C}_j)^T\cdot(C_i-\hat{C}_j)$$

which may be expanded as follows:

$$d(C_i, \hat{C}_j)=C_i^T\cdot C_i+\hat{C}_j^T\cdot\hat{C}_j-2\hat{C}_j^T\cdot C_i$$

If the two vector sets, $\{C_i\}$ and $\{\hat{C}_j\}$ are normalized so that $C_i^T\cdot C_i$ and $\hat{C}_j^T\cdot\hat{C}_j$ are fixed values for all i and j, the distance is minimum when $\hat{C}_j^T\cdot C_i$ is maximum. Thus, the essential computation for finding the value $\hat{C}_j$ that minimizes $d(C_i, \hat{C}_j)$ is the value of j that maximizes $$\hat{C}_j^T\cdot C_i=\sum_{h=1}^{12}\hat{c}_{jn}\cdot c_{in}$$

Each comparison requires the calculation of 12 products and eleven additions. As a result, a full search of the table of cepstral vectors requires 12×256=3072 multiplies and almost as many adds. Typically, this set of multiply-adds must be done at a rate of 100/second which corresponds to approximately $3\times10^5$ multiply-add operations per second. In addition, voice recognition systems, such as SPHINX, may have multiple VQ units for additional vector variables, such as power and differential cepstral, thereby requiring approximately $10^6$ multiply-add operations per second. This process requirement provides a strong motivation to find VQ encoding methods that require substantially less processing resources.

The invention to be described provides methods for increasing the speed of operation by reducing the computational burden.

SUMMARY AND OBJECTS OF THE INVENTION

One object of the present invention is to reduce the number of multiply-add operations required to perform a vector quantization conversion with minimal increase in quantization distortion.

Another object is to provide a choice of methods for the reduction of multiply-add operations with different levels of complexity.

Another object is to provide a probability distribution for each completed vector quantization by providing a distribution of probable code-book indices.

These and other objects of the invention are achieved by a vector quantization method that replaces the full search of the VQ code-book by deriving a binary encoding tree from a standard binary encoding tree that replaces multiply-add operations, required for comparing the candidate vector with a centroid vector at each tree node, by a comparison of a single vector element with a prescribed threshold. The single comparison element selected at each node is based on the node centroids determined during training of the vector quantizer code-book.

BRIEF DESCRIPTION OF THE DRAWINGS

The present invention is illustrated by way of example and not limitation in the figures of the accompanying drawings, in which like references indicate similar elements and in which.

DETAILED DESCRIPTION

A VQ method is described for encoding vector information using a code-book that is based on a binary tree that is built using simple one variable hyperplanes, requires only a single comparison at every node rather than using multi-variable hyperplanes requiring vector dot products of the candidate vector and the vector representing the centroid of the node.

Figure 1:
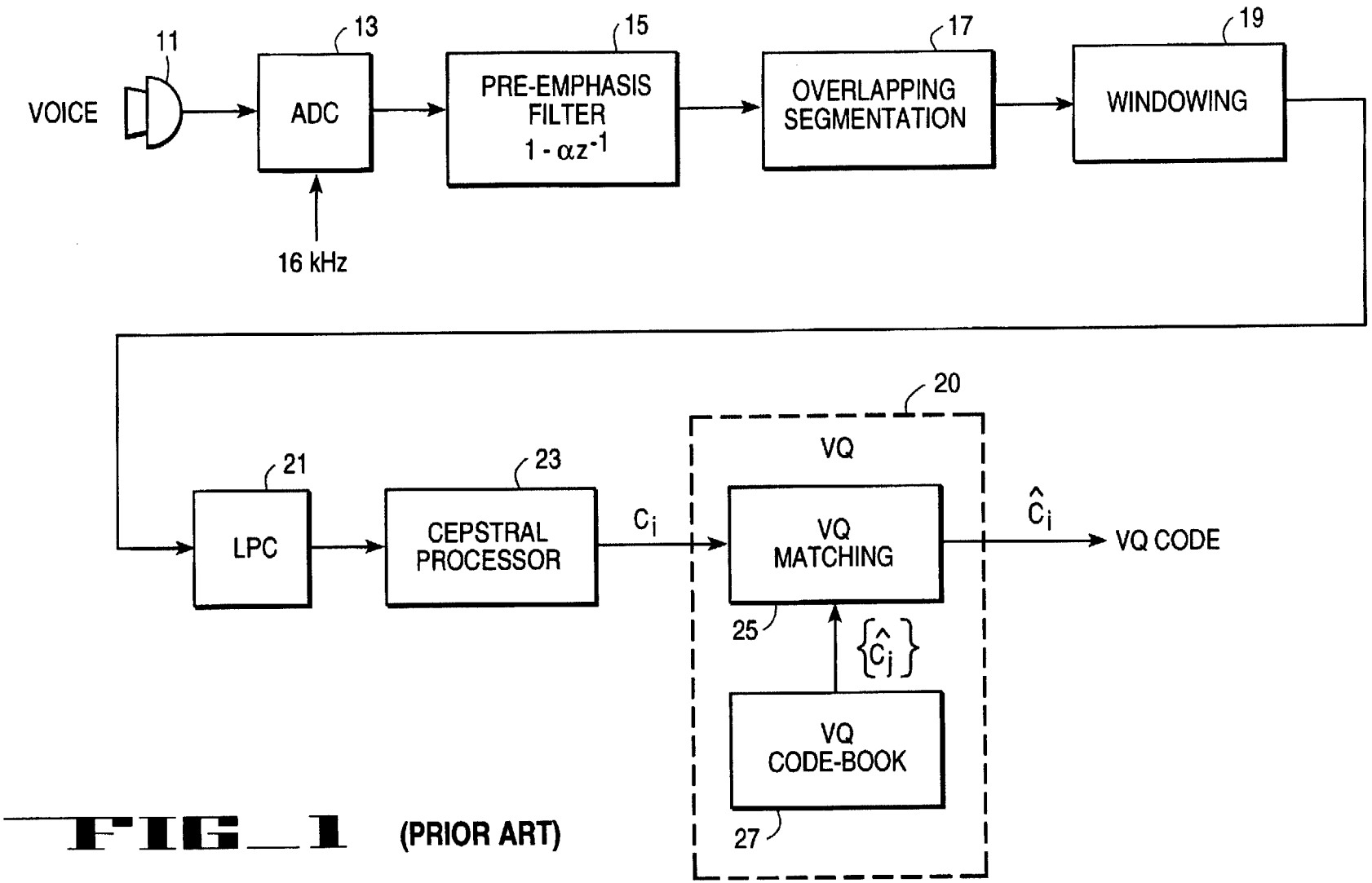
FIG. 1 (PRIOR ART)
FIG. 1 is a functional block diagram of a typical voice processing subsystem for the acquisition and vector quantization of voice data.
Figure 2:
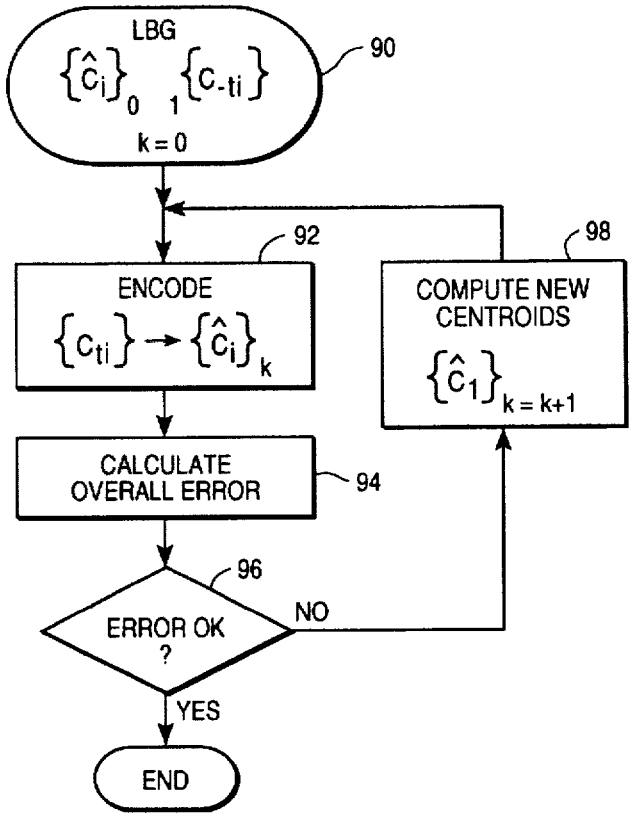
FIG 2 (PRIOR ART)
FIG. 2 is a flow diagram for the LBG algorithm used for the training of a VQ code-book.
Figure 3:
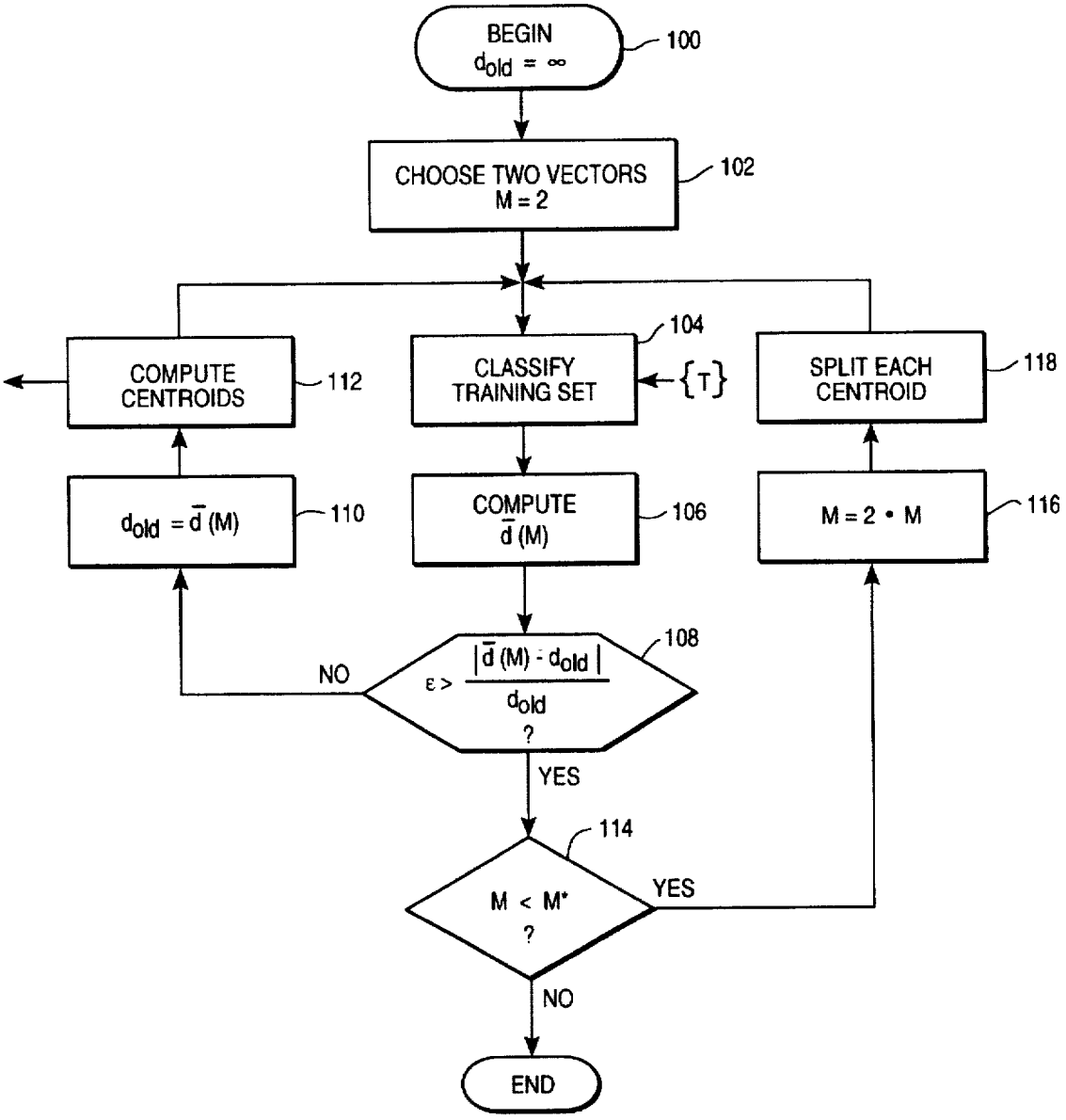
FIG 3 (PRIOR ART)
FIG. 3 is a flow diagram of another LBG training process for generating a VQ code-book.

VQ quantization methods are based on a code-book (memory) containing the coordinates of the centroids of a limited group of representative vectors. The coordinates describe the centroid of data clusters as determined by the training data that is operated upon by an algorithm such as described in FIGS. 2 and 3. The centroid location is represented by a vector whose elements are of the same dimension as the vectors used in training. A training method based on a binary tree produces a code-book vector set with a binary number of vectors, $2^L$, where L is the number of levels in the binary tree.

If the VQ encoding is to maintain the inherent accuracy of the code-book, as determined by the quality and quantity of the training data, each candidate vector that is presented for VQ encoding should be compared with each of the $2^L$ code-book vectors so as to find the closest code-book vector. However, as previously discussed, the computational burden implied by finding the nearest code-book vector may be unacceptable. Consequently, "short-cut" methods have been explored that hopefully lead to more efficient encoding without an unacceptable increase in distortion (error).

One encoding procedure known as "binary tree-search" is used to reduce the number of vector dot products required from $2^L$ to L, (Gray, R. M., "Vector Quantization", IEEE ASSP Magazine, Vol. 1, No. 2, April 1984, pp. 11–12). The procedure may be explained by reference to the binary tree of FIG. 4 where the nodes are indexed by (I, k) where I corresponds to the level and k to the left to right position of the node.

When the code-book is being trained, centroids are established for each of the nodes of the binary tree. These intermediate centroids are stored for later use together with the final $2^L$ set of centroids used for the code-book.

When a candidate vector is presented for VQ encoding, the vector is processed in accordance with the topology of the binary tree. At level 1, the candidate vector is compared with the two centroids of level 1 and the closest centroid is selected. The next comparison is made at level 2 between the candidate vector and the two centroids connected to the selected level 1 centroid. Again, the closest centroid is selected. At each succeeding level a similar binary decision is made until the final level is reached. The final centroid index ($k=0, 1, 2, \ldots, 2^L-1$) represents the VQ code assigned to the candidate vector. The emboldened branches of the graph indicate one plausible path for the four level example.

Figure 5:
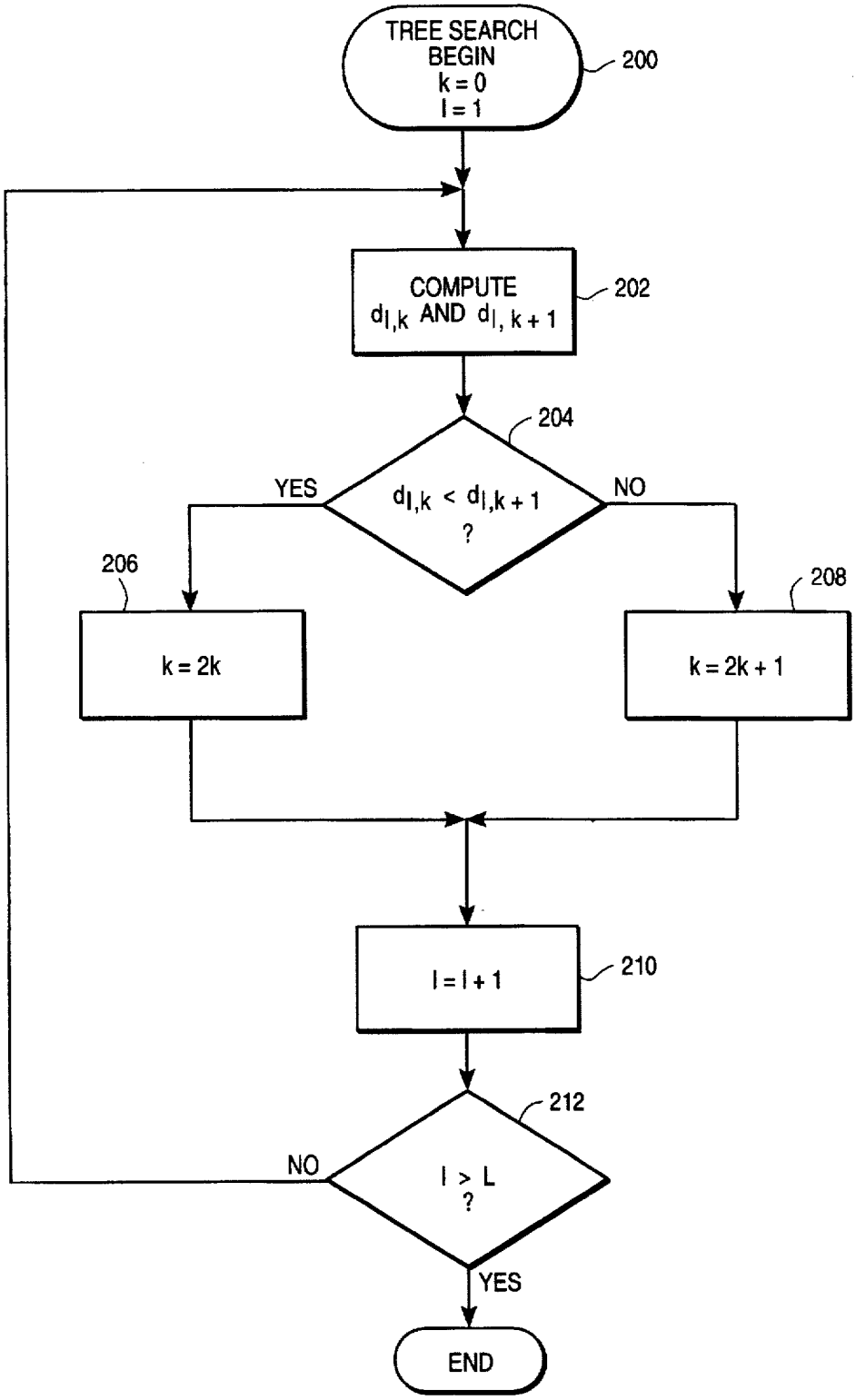
FIG. 5 is a binary tree search flow diagram.

The flow diagram of FIG. 5 is a more detailed description of the tree search algorithm. The process begins at step 200 setting the centroid indices (I, k) equal to (1,0). Step 202 computes the distance between the candidate vector and the two adjacent centroids located at level I and positions k and k+1. Step 204 tests to determine the closest centroid and increments the k index in steps 206 and 208 depending on the outcome of test step 204. Step 210 increments the level index I by one and step 212 tests if the final level, L, has been processed. If so, the process ends and, if not, the new (I, k) indices are returned to step 202 where another iteration begins.

The significant point is that the above tree-search procedure is completed in L steps for a code-book with $2^L$ entries. This results in a considerable reduction in the number of vector-dot multiply operation, from $2^L$ to 2L. This implies, for the 256 entry code-book, a reduction of 16 to one. In terms of multiply-add operations for each encoding operation, a reduction from 3,072 to 192 is realized.

A significantly greater improvement in processing efficiency may be obtained by using the following inventive design procedure in conjunction with a standard distance based training method used to generate the VQ code-book.

1. Construct a binary-tree code-book in accordance with a standard process such as those previously described.
2. After the centroid of each node in the tree is determined, examine the elements of the training vectors and determine which one vector element value, if used as a decision criterion for binary splitting would cause the training vector set to split most evenly. The selected element associated with each node is noted and stored together with its critical threshold value that separates the cluster into two more or less equal clusters.
3. Apply the training vectors used to construct the code-book to a new binary decision tree wherein the binary decision based on the centroid of the node is replaced by a threshold decisions. For each node, step 2 above established a threshold value of a selected candidate vector component. That threshold value is compared with each training candidate's corresponding vector element value and the binary sorting decision is made accordingly, moving on to the next level of the tree.
4. Because this thresholding encoding process is sub-optimum, each training vector may not follow the same binary decision path that it traced in the original training cycle. Consequently, each time a training vector belonging to a given set, as determined by the original training procedure, is classified by the thresholded binary-tree, its "true" or correct classification is noted in whatever bin it ultimately ends up. In this manner a histogram is created and associated with each of the code-book indices (leaf nodes) indicating the count of the members of each set that were classified by the threshold binary tree procedure as belonging to that leaf node. These histograms are indicative of the probability that a given candidate vector belonging to index q may be classified as belonging to q'.

Figure 6A:
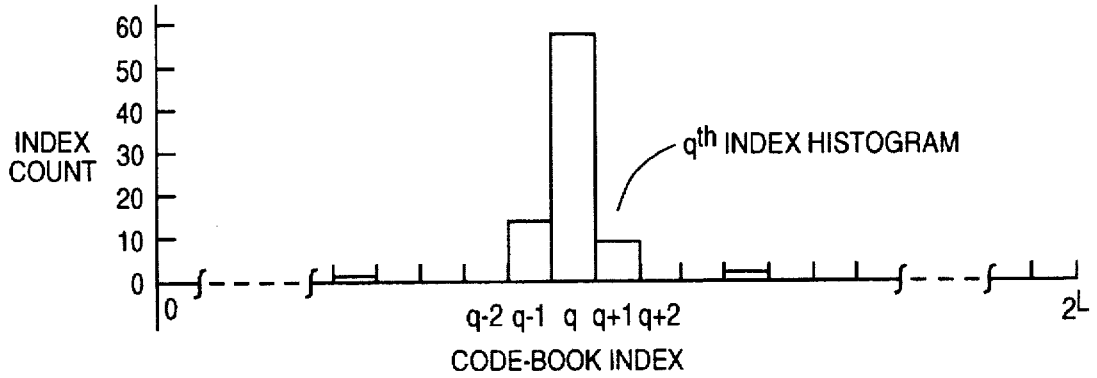
FIGS. 6(*a*) and 6(*b*) are example of code-book histograms.
Figure 6B:
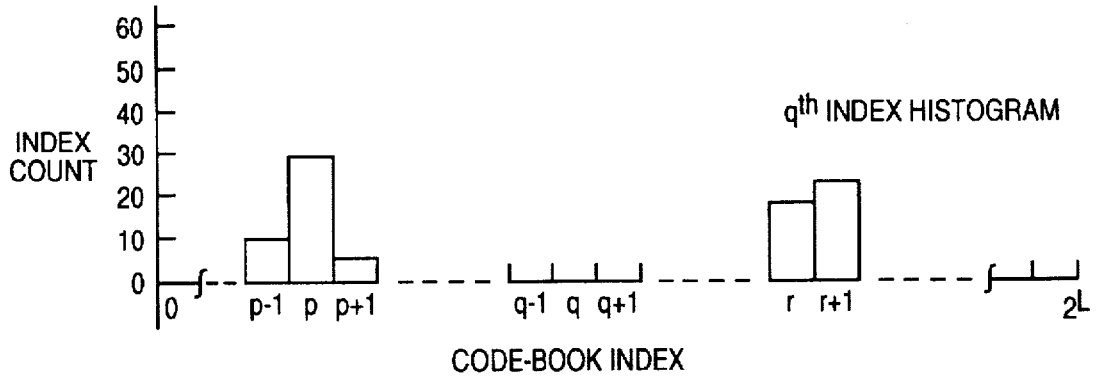

FIG. 6(*a*) and (*b*) show two hypothetical histograms that might result from the $q^{th}$ code-book index. In FIG. 6(*a*), the histogram tends to be centered about the q index. In other words, most vectors that were classified as belonging to set q were members of q as indicated by the count of 60. However, the count of 15 in histogram bin q−1 indicates that 15 training vectors of set q−1 were classified as belonging to set q. Similarly, 10 vectors belonging to training vector set q+1 were classified as belonging to set q. A histogram with a tight distribution, as shown in FIG. 6(*a*), indicates that the clusters are almost completely separable in the multi-dimensioned vector space by simple orthogonal linear hyperplanes rather than linear hyperplanes of full dimensionality.

Figure 7A:
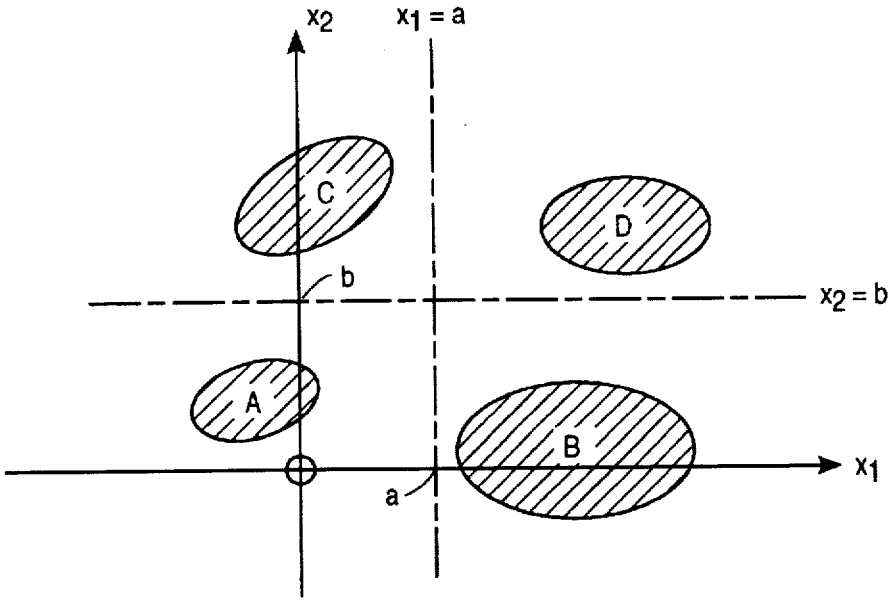
FIGS. 7(*a*) and 7(*b*) show examples of separating two-space by linear hyperplanes.
Figure 7B:
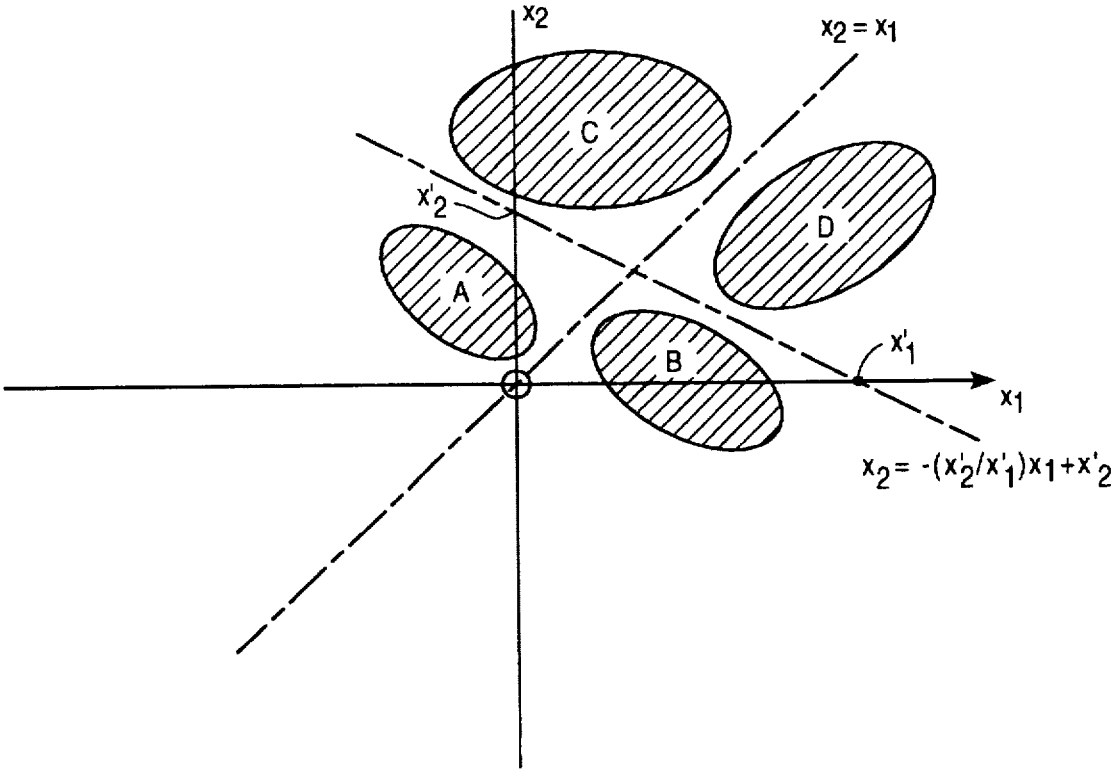

This concept is represented for two-dimensional vector space in FIG. 7(*a*) and (*b*). FIG. 7(*a*) shows four vector sets (A, B, C, and D) in the two dimensional $(x_1, x_2)$ plane that may be separated by two single numbers $x_1=a$ and $x_2=b$ represented by the two perpendicular straight lines passing through $x_1=a$ and $x_2=b$ respectively. This corresponds to two simple linear hyperplanes of two-space. FIG. 7(*b*) shows four groups (A, B, C, and D) that cannot be separated by simple two-space hyperplanes but requires the use of full two-dimensional hyperplanes represented by $x_2=-(x_2'/x_1')x_1+x_2'$ and $x_2=x_1$.

The histograms of FIG. 6(*b*) for the $q^{th}$ code-book index, implies that the training vector set is not separable by a simple one-dimensional specification of the linear hyperplanes. The $q^{th}$ histogram indicates that no training vector belonging to set q was classified as a member of q by the binary tree thresholding procedure.

Figure 8A:
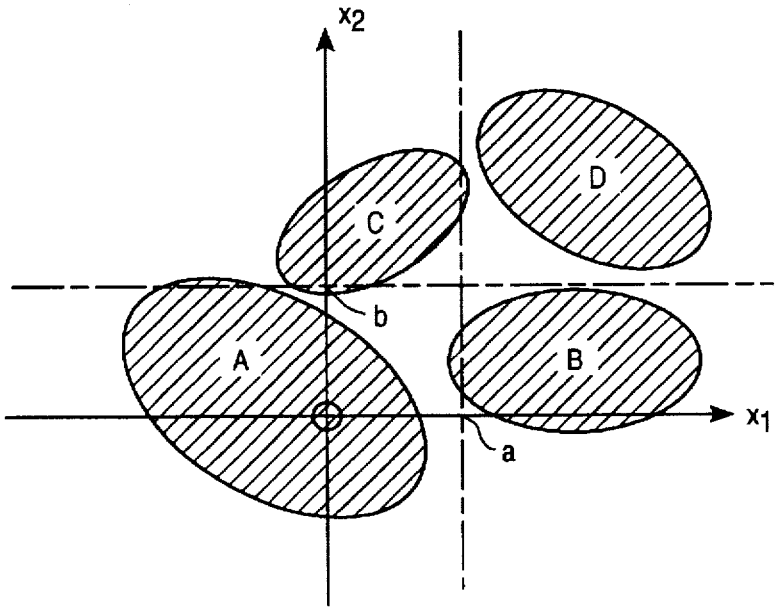
FIGS. 8(*a*) and 8(*b*) show examples of the failure of simple linear hyperplanes to separate sets in two-space.
Figure 8B:
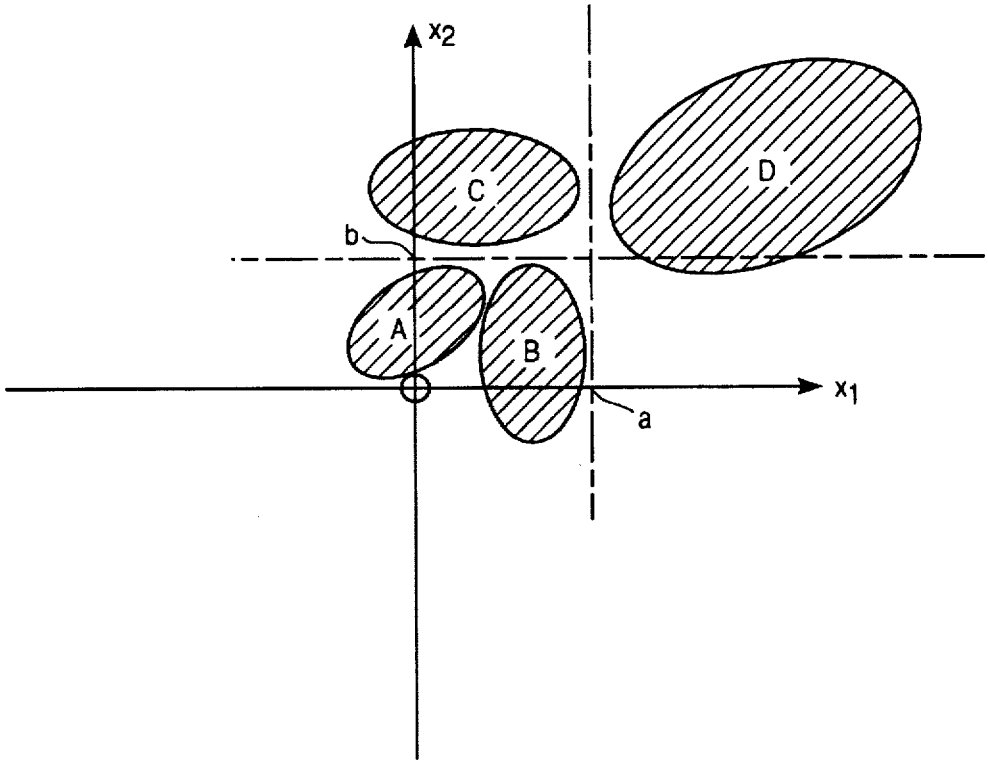

FIGS. 8(*a*) and (*b*) are two-space examples of the histogram of FIGS. 6(*a*) and (*b*) respectively. In FIG. 8(*a*) the best vertical or horizontal lines used for separating the four sets (A, B, C, and D) will cause some misclassification as indicated by the overlap of subset A and C, for example. In FIG. 8(*b*), using the same orthogonal set of two-space hyperplanes ($x_1=a$, $x_2=b$), sets A and B would be classified in the same set leaving one out of four subsets empty except that some members of subset D would be counted in the otherwise empty set.

In this manner, a new code-book is generated in which the code-book index represents a distribution of vectors rather than a single vector, represented by a single centroid. Normalizing the histogram counts by dividing each count by the total number of counts in each set of vectors, results in an empirical probability distribution for each code-book index.

Figure 9:
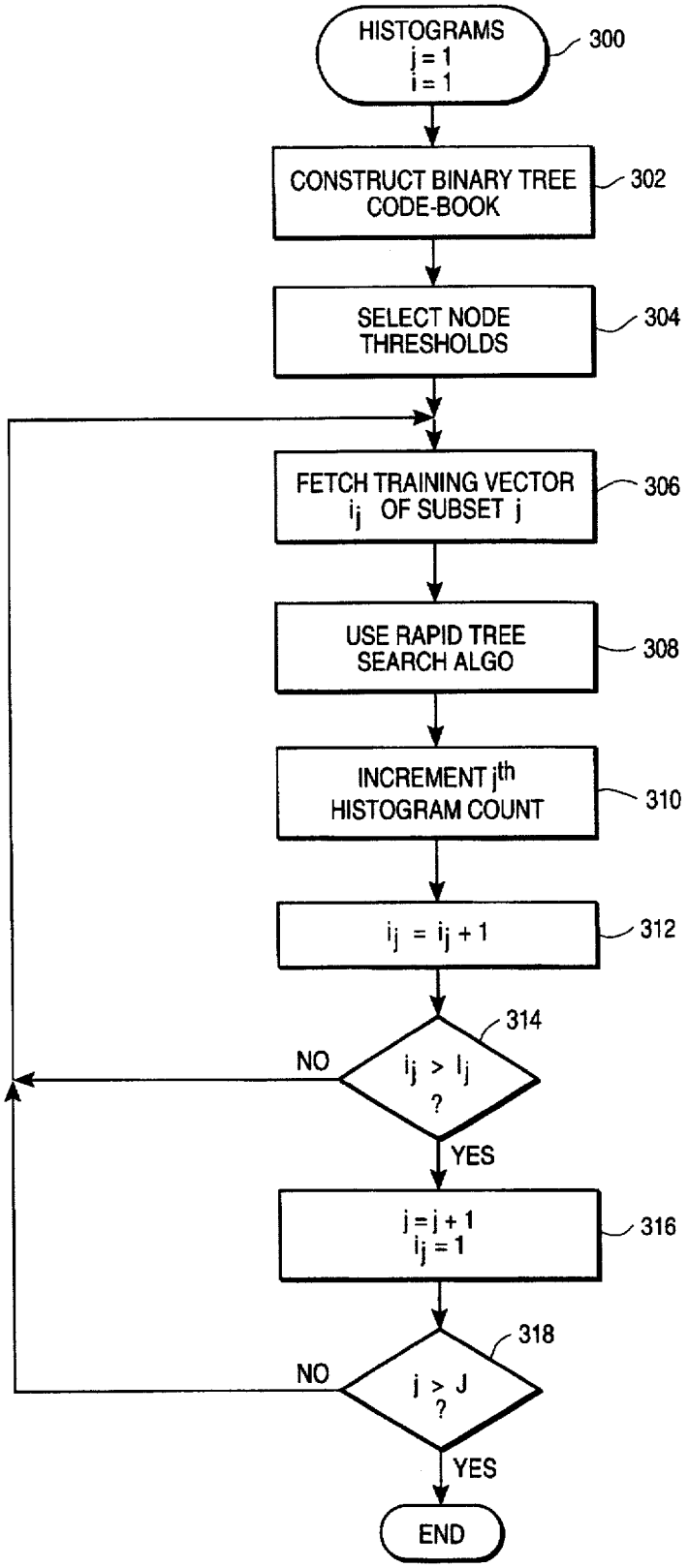
FIG. 9 is a flow diagram of the method for generating VQ code-book histograms.

FIG. 9, is a flow diagram for code-book histogram generation that begins at step 300 where indices j and i are initialized. Step 302 constructs a code-book with a binary number of entries using any of the available methods based on a distance metric. Step 304 selects a node parameter and threshold from the node centroid vector for each binary-tree node. Step 306 fetches the training vector of subset j (all vectors belonging to code-book index j), and a rapid tree search algorithm is applied in step 308. The result of step 308 is applied in step 310 by incrementing the appropriate bin (leaf node) of the histogram associated with the final VQ index. Step 312 increments the index and step 314 tests if all training vectors of set j have been applied. If not, the process returns to step 306 for another iteration. If all member vectors of training set j are exhausted, step 316 increments index j and resets $i_j$. Test step 318 checks if all training vectors have been used and, if not, returns to step 306. Otherwise, the process terminates.

Having created this code-book of vector distributions, it may be used for VQ encoding of new input data.

Figure 4:
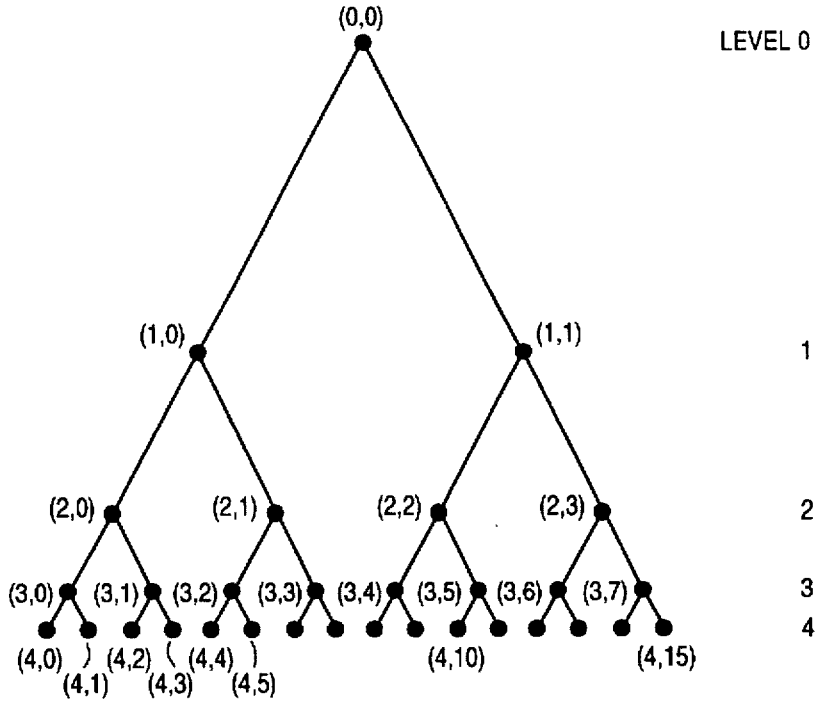
FIG. 4 is a binary tree search example.

A rapid tree search encoder procedure would follow the same binary tree structure shown in FIG. 4. A candidate vector would be examined at level 0 and the appropriate vector element value would be compared against the level 0 prescribed threshold value and then passed on to the appropriate next (level 1) node where a similar examination and comparison would be made between the prescribed threshold value and the value of the preselected vector element corresponding to the level 1 node. A second binary-split decision is made and the process passes on to the level 2. This process is repeated L times for a code-book with $2^L$ indices. In this manner, a complete search may be completed by L simple comparisons, and no multiply-add operations.

Having reached the $L^{th}$ level leaf nodes of the binary search process, the encoded result is in the form of a histogram as previously described. A decision as to which histogram index is most appropriate is made at this point by computing the distance between the candidate vector and the centroids of the non-zero indices (leafs) of the histogram and selecting the VQ code-book index corresponding to the nearest centroid.

Figure 10:
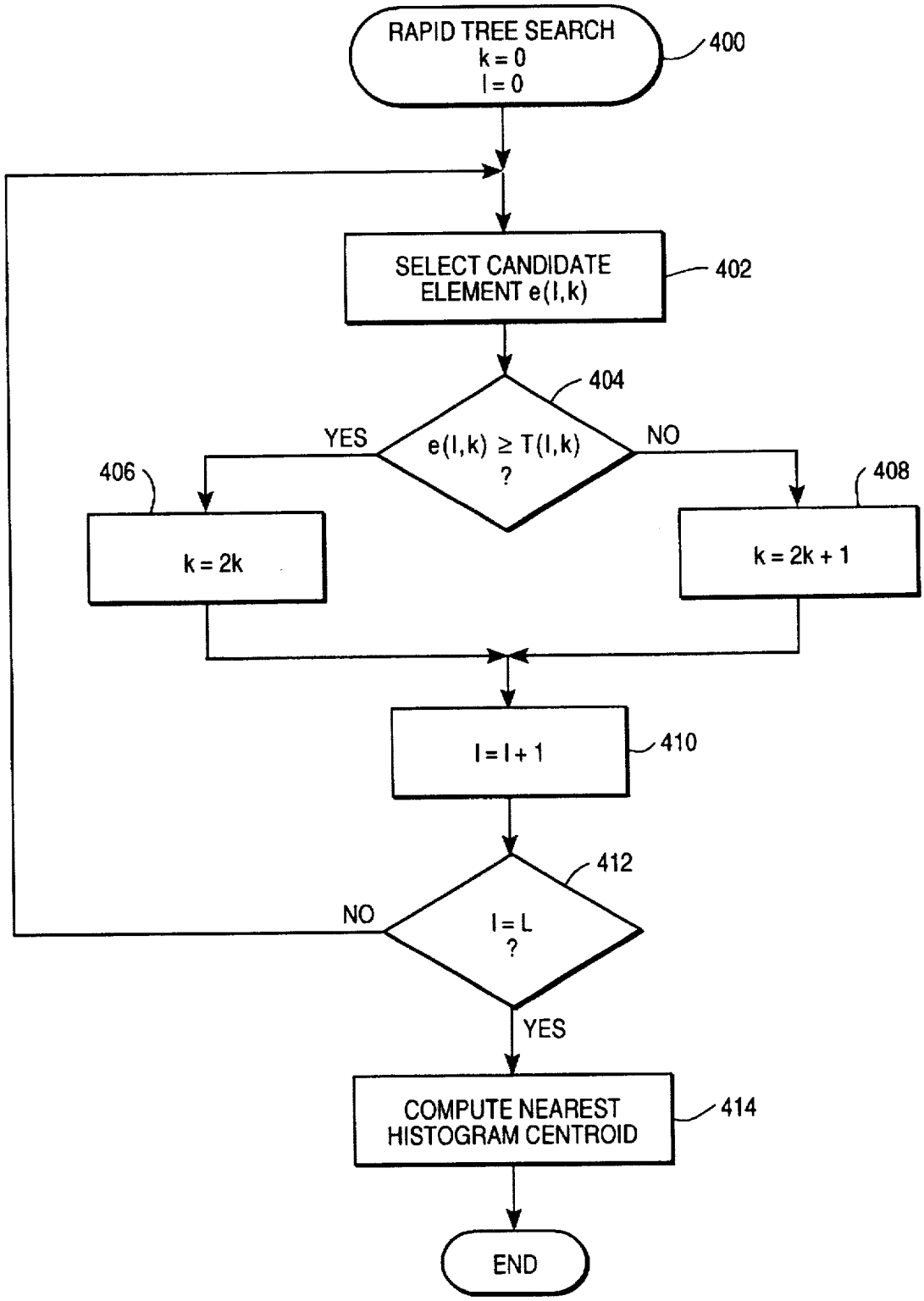
FIG. 10 is a flow diagram of the rapid tree-search method for VQ encoding.

Rapid tree-search is described in the flow diagram of FIG. 10. The binary-tree level index I and node row index k are initialized in step 400. Step 402 selects element e(I, k) from the VQ candidate vector corresponding to the preselected node threshold value T(I, k). Step 404 compares e(I, k) with T(I, k) and if its exceeds threshold step 406 doubles the value of k and if not, doubles and increments k in step 408. Index I is incremented in step 410. Step 412 determines if all prescribed levels (L) of the binary tree have been searched and if not returns to step 402 for another iteration. Otherwise, step 414 selects the VQ code-book index by computing the distance between the candidate vector and the centroids of the non-zero indices (leafs) of the histogram. The nearest centroid corresponding to the histogram bin indices (leafs) is selected. The process is then terminated.

An additional variant allows a trade-off between having more internal nodes with finer divisionals (resulting in fewer leaf histograms and hence fewer distance comparisons) and fewer internal nodes with coarser divisions and more histograms. Hence for machines in which distance comparisons are costly, a smaller tree with less internal nodes would be favored.

Another design choice involves the trade-off between memory and encoding speed. Larger trees would probably be faster but require more storage of internal node threshold decisions values.

Another embodiment that affects step 414 of FIG. 10 utilizes the histogram count to establish the order in which the centroid distances are computed. The centroid corresponding to the leaf with the highest histogram count is first chosen as a possible code and the distance between it and the candidate vector to be encoded is computed and stored. The distance between the candidate vector centroid and the centroid of the next highest histogram count leaf code-book vector is calculated incrementally. The incremental partial distance between candidate vector, C, and the leaf code-book vector, $\hat{C}_j$, is calculated as follows:

$1^{st}$ increment: $D_{j1} = |c_1 - \hat{c}_{j1}|$ $2^{nd}$ increment: $D_{j2} = |c_1 - \hat{c}_{j1}| + |c_2 - \hat{c}_{j2}|$

.

.

.

$n^{th}$ increment: $D_{jn} = |c_1 - \hat{c}_{j1}| + |c_2 - \hat{c}_{j2}| + \ldots + |c_k - \hat{c}_{jn}|$

.

.

.

$N^{th}$ increment: $D_j = \sum_{i=1}^{N} |c_j - \hat{c}_{ji}|$ where the candidate vector is $C=[c_1 c_2 \ldots c_N]$, the leaf code-book vector is $\hat{C}_j=[\hat{C}_{j1}\hat{C}_{j2} \ldots \hat{C}_{jN}]$, and $|\cdot|$ is an appropriate distance metric function. After each incremental distance calculation, a comparison is made between the calculated incremental second distance, $D_{2n}$, and the distance, $D_{min}-D_1$, between the candidate vector C and the highest histogram count leaf vector $C_1$ where $$D_1 = \sum_{i=1}^{N} |c_i - c_{1i}|.$$

If the value $D_{min}$ is exceeded, the calculation is discontinued because each incremental distance contribution, $|c_n-\hat{c}_{jn}|$, is equal to or greater than zero. If the calculation is completed and the computed distance is less than $D_1$, $D_2$ replaces $D_1$ ($D_{min}=D_2$) as the trial minimum distance. Having made the distance comparison for vector $\hat{C}_2$, the process is repeated for the next code-book leaf vector in descending order of the histogram count. It should be noted that the actual histograms need not be stored but only the ordering of the leaf vectors in accordance with descending histogram count. The code-book vector corresponding to the final minimum distance, $D_{min}$, is selected. By use of this incremental distance metric method, additional computational efficiency may be realized by the user.

Figure 11:
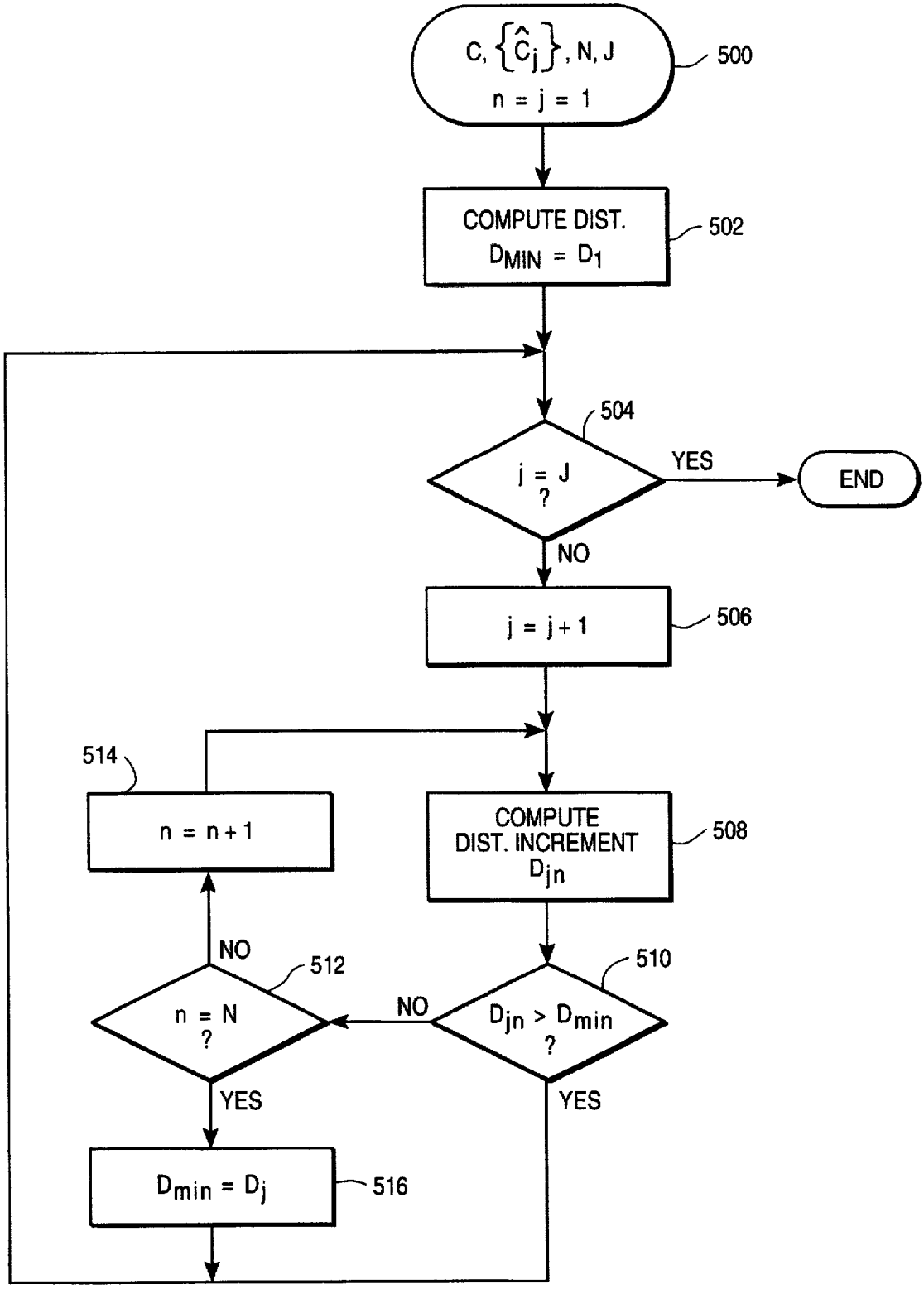
FIG. 11 is a flow diagram representing an incremental distance comparison method for selecting the VQ code.

FIG. 11 is a flow diagram representing the computation of the nearest code-book leaf centroid as required by step 414 of FIG. 10.

The process begins at step 500 where the candidate vector C, the set of code-book leaf centroids, $\{\hat{C}_j\}$, distance increment index n=1, leaf index j=1, the number of vector elements N, and the number of leaf centroids J are given. In step 502 the distance between the highest ranked (highest histogram count) leaf centroid C, (j=1) and the candidate vector C is computed and set equal to $D_{min}$. Step 504 checks to see if all leaf centroids have been exhausted. If so, the process ends and the value of j corresponds to the leaf index of the closest centroid. The code-book index of the closest centroid is taken as the VQ code of the input vector.

If all leaf centroids are not exhausted, step 506 increments j and the incremental distance $D_{jn}$ is computed in step 508. In step 510, $D_{jn}$ is compared with $D_{min}$, and if less proceeds to step 512 where the increment index is checked. If less than the number of vector elements, N, index n is incremented in step 514 and the process returns to step 508.

If n=N in step 512, the process moves to step 516 where $D_{min}$ is set equal to $D_j$, indicating a new minimum distance corresponding to leaf centroid j, and the process moves back to step 504.

If $D_{jn}$ is greater than $D_{min}$, the incremental distance calculation is terminated and the process moves back to step 504 for another iteration.

Figure 12:
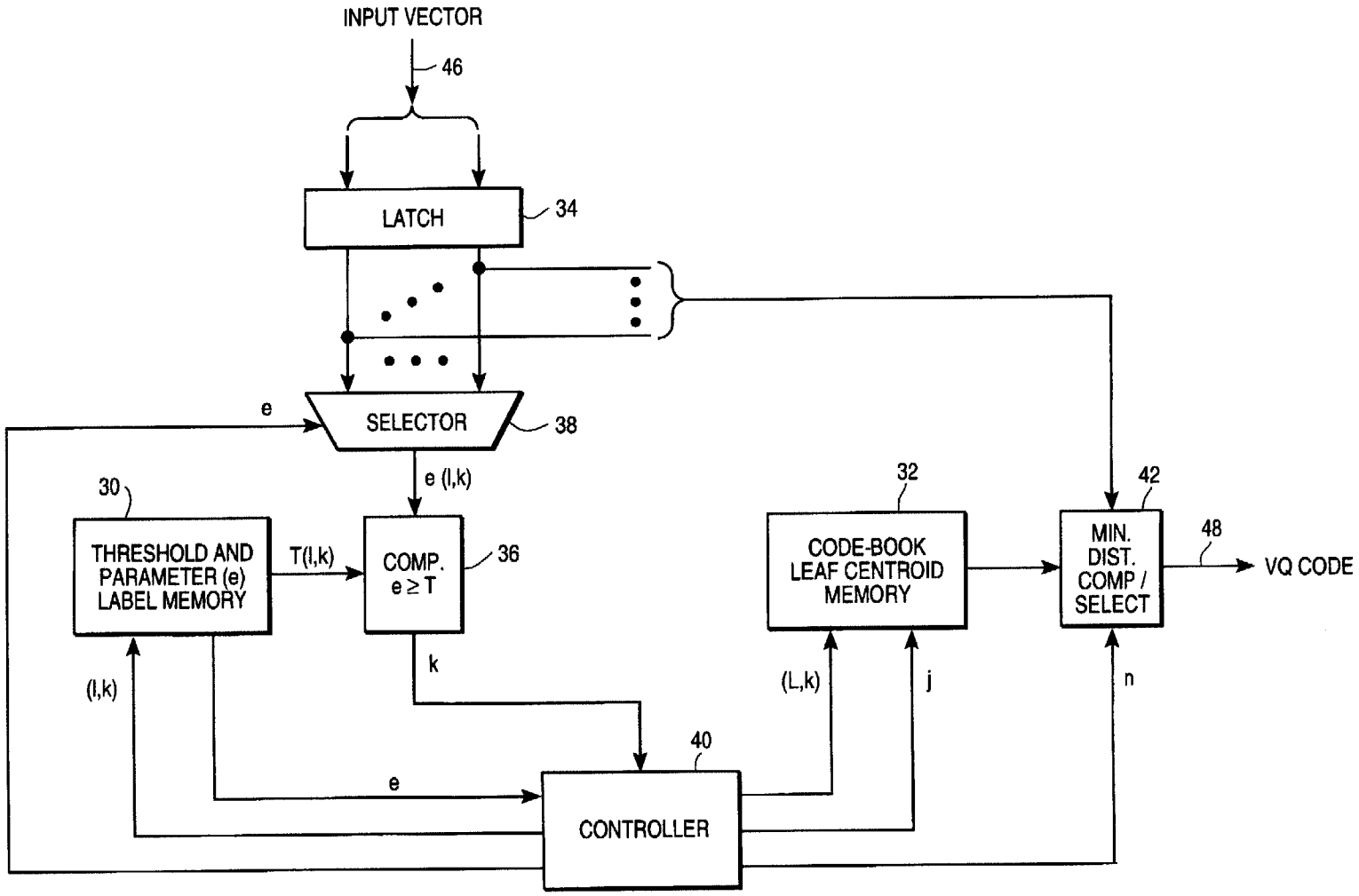
FIG. 12 shows apparatus for rapid tree-based vector quantization.

FIG. 12 shows a rapid tree vector quantization system. The candidate vector to be vector quantized is presented at input terminals 46 and latched into latch 34 for the duration of the quantization operation. The output of latch 34 is connected to selector unit 38 whose output is controlled by controller 40. Controller 40 selects a given vector element value, e(I,k), of the input candidate vector for comparison with a corresponding stored threshold value, T(I,k).

The output of comparator 36 is an index k which is determined by the relative value of e(I,k) and T(I,k), in accordance with steps 404, 406 and 408 of FIG. 10. Controller 40 receives comparator 36 output and generates an instruction to threshold and vector parameter label memory 30 indicating the position of the next node in the binary search by the index pain (I,k), where I represents the binary tree level and k the index of the node in level I. Memory 30 delivers the next threshold value T(I,k) to comparator 36 and the associated vector element index, e, which is used by controller 40 to select the corresponding element of the candidate vector, e(I,k) using selector 38.

After reaching the lowest level, L, of the binary tree, controller 40 addresses the contents of code-book leaf centroid memory 32 at an address corresponding to (L,k), and makes available the set of code-book leaf centroids associated with binary tree node (L,k) to minimum distance comparator/selector 42. Controller 40, increments control index j that sequentially selects the members of the set of code-book leaf centroids. Comparator/selector 42 calculates the distance between the code-book leaf centroids and the input candidate vector and then selects the closest code-book leaf centroid index as the VQ code corresponding to the candidate input vector. Controller 40 also provides control signals for indexing the partial distance increment for comparator/selector 42.

A further variation of the rapid tree-search method would include the "pruning" of low count members of the histograms on the justification that their occurrence is highly unlikely and therefore is not a significant contributor to the expected VQ error.

The importance of rapidly searching a code-book for the nearest centroid increases when it is recognized that voice systems may have multiple code-books. Lee (op. cit., p. 69) describes a multiple code-book speech recognition system in which three code-books are used: a cepstral, a differenced cepstral, and a combined power and differenced power code-book. Consequently, the processing requirements increase in direct proportion to the number of code-books employed.

The rapid-tree VQ method described was tested on the SPHINX system and the results improved to the results obtained by a conventional binary tree search VQ algorithm. Typical results for distortion are given below for three different speakers (A, B, and C).

| | | Distortion | | |
|---|---|---|---|---|
| | VQ Mode | Speaker A | Speaker B | Speaker C |
| Training Data | Normal VQ | 0.0801 | 0.0845 | 0.0916 |
| | Rapid Tree VQ | 0.0800 | 0.0845 | 0.0915 |
| Test Data | Normal VQ | 0.0792 | 0.0792 | 0.0878 |
| | Rapid Tree VQ | 0.0771 | 0.0792 | 0.0871 |

The processing times for both methods and for the same three speakers was also measured as shown below.

| | Timing | | |
|---|---|---|---|
| VQ Mode | Speaker A | Speaker B | Speaker C |
| Normal VQ | 0.1778 | 0.1746 | 0.1788 |
| Rapid-Tree | 0.0189 | 0.0190 | 0.0202 |

These results indicate that comparable distortion resulted from the conventional VQ and the rapid tree search VQ methods. However, the processing speed was increased by a factor of more than 9 to 1.

In the foregoing specification, the invention has been described with reference to specific embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method for converting a candidate vector signal into a vector quantization (VQ) signal, the candidate vector signal identifying a candidate vector having a plurality of elements, the method comprising the steps of:

(a) applying the candidate vector signal to circuitry which performs a binary search of a binary tree stored in a memory, wherein the candidate vector signal is a digitized representation, wherein the binary tree has intermediate nodes and leaf nodes, and wherein the applying step (a) comprises the steps of:

(i) selecting one of the elements of the candidate vector and comparing the selected element with a corresponding threshold value for each intermediate node traversed in performing the binary search of the binary tree, and (ii) identifying one of the leaf nodes encountered in the binary search of the binary tree;

(b) identifying, based on the identified leaf node, a set of VQ vectors stored in a memory;

(c) selecting one of the VQ vectors from the identified set of VQ vectors; and (d) generating the VQ signal identifying the selected VQ vector.

2. The method of claim 1, comprising the step of converting with an analog-to-digital converter a sound into the candidate vector signal for speech recognition, wherein the VQ signal generated in step (d) is an encoded signal representative of the sound.

3. The method of claim 2, comprising the step of providing with a microphone an analog representation of the sound to the analog-to-digital converter, wherein the VQ signal identifies a VQ index to identify the selected VQ vector.

4. The method of claim 1, wherein the candidate vector includes one of a cepstral vector, a power vector, a cepstral difference vector, and a power difference vector.

5. The method of claim 1, wherein the selecting step (c) comprises the step of selecting one of the VQ vectors that is closest to the candidate vector.

6. The method of claim 5, wherein the selecting step (c) comprises the step of determining a distance between the candidate vector and each VQ vector of the identified set of VQ vectors.

7. The method of claim 5, wherein the identifying step (b) comprises the step of identifying, based on the identified leaf node, a histogram identifying a distribution of candidate vectors over the set of VQ vectors; and wherein the selecting step (c) comprises the steps of:

(i) selecting one of the VQ vectors identified by the histogram as having a highest count, (ii) determining a distance between the candidate vector and the VQ vector identified as having the highest count, (iii) selecting another one of the VQ vectors identified by the histogram as having a next highest count, (iv) determining at least a partial incremental distance between the candidate vector and the VQ vector identified as having the next highest count, (v) repeating the selecting step (iii) and the determining step (iv) until a predetermined number of VQ vectors of the set of VQ vectors have been selected, and (vi) selecting one of the VQ vectors that has a minimum distance as determined by the determining steps (it) and (iv).

8. A method for converting a candidate vector signal into a vector quantization (VQ) signal, the candidate vector signal identifying a candidate vector, the method comprising the steps of:

(a) generating a binary tree having intermediate nodes and leaf nodes;

(b) storing the binary tree in a memory;

(c) determining for each intermediate node of the binary tree a corresponding element of each of a plurality of training vectors and a corresponding threshold value;

(d) performing a binary search of the binary tree for each training vector, wherein the performing step (d) includes the steps of:

(i) comparing the corresponding element of each training vector with the corresponding threshold value for each intermediate node traversed in performing the binary search of the binary tree, and (ii) identifying for each training vector one of the leaf nodes encountered in the binary search of the binary tree;

(e) generating a plurality of sets of VQ vectors, wherein each set of VQ vectors corresponds to one of the identified leaf nodes of the binary tree;

(f) storing each set of VQ vectors in a memory;

(g) applying the candidate vector signal to circuitry which performs a binary search of the binary tree to identify one of the sets of VQ vectors;

(h) selecting one of the VQ vectors from the identified set of VQ vectors; and (i) generating the VQ signal identifying the selected VQ vector.

9. The method of claim 8, comprising the step of converting with an analog-to-digital converter a sound into the candidate vector signal for speech recognition, wherein the VQ signal generated in step (i) is an encoded signal representative of the sound.

10. The method of claim 9, comprising the step of providing with a microphone an analog representation of the sound to the analog-to-digital converter, wherein the VQ signal identifies a VQ index to identify the selected VQ vector.

11. The method of claim 8, wherein the determining step (c) includes the step of determining the corresponding element of one of the training vectors such that using a prescribed value of the corresponding element as the corresponding threshold value for one of the intermediate nodes would tend to separate candidate vectors evenly in traversing from the one intermediate node to one of two other nodes of the binary tree.

12. The method of claim 8, wherein the candidate vector includes one of a cepstral vector, a power vector, a cepstral difference vector, and a power difference vector.

13. The method of claim 8, wherein the selecting step (h) comprises the step of selecting one of the VQ vectors that is closest to the candidate vector.

14. The method of claim 8, wherein the generating step (e) includes the step of generating a plurality of histograms, wherein each histogram corresponds to one of the identified leaf nodes and wherein each histogram identifies a distribution of training vectors over one of the sets of VQ vectors.

15. The method of claim 14, comprising the step of normalizing one of the histograms.

16. An apparatus for converting a candidate vector signal into a vector quantization (VQ) signal, the candidate vector signal identifying a candidate vector having a plurality of elements, the apparatus comprising:

(a) a first memory which stores a binary tree having intermediate nodes and leaf nodes;

(b) control circuitry, coupled to the first memory, which performs a binary search of the binary tree, wherein the control circuitry comprises:

(i) a selector which receives the candidate vector signal and which selects one of the elements of the candidate vector for each intermediate node traversed in performing the binary search of the binary tree, and (ii) a comparator, coupled to the first memory and to the selector, which compares the selected element with a corresponding threshold value for each intermediate node traversed in performing the binary search of the binary tree, the control circuitry identifying one of the leaf nodes encountered in the binary search of the binary tree; and (c) a second memory, coupled to the control circuitry, which stores a set of VQ vectors corresponding to the identified leaf node;

the control circuitry identifying the set of VQ vectors corresponding to the identified leaf node, selecting one of the VQ vectors from the identified set of VQ vectors, and generating the VQ signal identifying the selected VQ vector.

17. The apparatus of claim 16, further comprising an analog-to-digital converter, coupled to said control circuitry, for converting a sound into the candidate vector signal for speech recognition, wherein the generated VQ signal is an encoded signal representative of the sound.

18. The apparatus of claim 17, further comprising a microphone coupled to the analog-to-digital converter, the microphone providing an analog representation of the sound to the analog-to-digital converter, wherein the VQ signal identifies a VQ index to identify the selected VQ vector.

19. The apparatus of claim 16, wherein the candidate vector includes one of a cepstral vector, a power vector, a cepstral difference vector, and a power difference vector.

20. The apparatus of claim 16, wherein the control circuitry selects one of the VQ vectors that is closest to the candidate vector.

21. The apparatus of claim 20, wherein the control circuitry determines a distance between the candidate vector and each VQ vector of the identified set of VQ vectors to select one of the VQ vectors.

22. The apparatus of claim 20, wherein the control circuitry identifies the set of VQ vectors by identifying, based on the identified leaf node, a histogram identifying a distribution of candidate vectors over the set of VQ vectors, and wherein the control circuitry selects one of the VQ vectors by:

(i) selecting one of the VQ vectors identified by the histogram as having a highest count, (ii) determining a distance between the candidate vector and the VQ vector identified as having the highest count, (iii) selecting another one of the VQ vectors identified by the histogram as having a next highest count, (iv) determining at least a partial incremental distance between the candidate vector and the VQ vector identified as having the next highest count, (v) repeating the selection of other VQ vectors and the determination of incremental distances until a predetermined number of VQ vectors of the set of VQ vectors have been selected, and (vi) selecting one of the VQ vectors that has a minimum distance to the candidate vector.

* * * * *

UNITED STATES PATENT AND TRADEMARK OFFICE

CERTIFICATE OF CORRECTION

PATENT NO. : 5,734,791

DATED : March 31, 1998

INVENTOR(S) : Acero et al.

It is certified that error appears in the above-identified patent and that said Letters Patent is hereby corrected as shown below:

In column 12 at line 16 delete "(it)" and insert --(ii)--

Signed and Sealed this

Fourteenth Day of July, 1998

Bruce Lehman

*Attest:*

BRUCE LEHMAN

*Attesting Officer*

*Commissioner of Patents and Trademarks*